US005388486A

United States Patent [19]

Ruzicka et al.

[11] Patent Number: 5,388,486

[45] Date of Patent: * Feb. 14, 1995

[54] ROTARY WRENCHING TOOL

[76] Inventors: Josef Ruzicka, 1705 Summit Ave., St. Paul, Minn. 55105; Petr O. Ruzicka, 117 Parsonage Hill Rd., Short Hills, N.J. 07078; Milan Ruzicka, 1705 Summit Ave., St. Paul, Minn. 55105

[ * ] Notice: The portion of the term of this patent subsequent to Jun. 15, 2010 has been disclaimed.

[21] Appl. No.: 61,634

[22] Filed: May 12, 1993

Related U.S. Application Data

[63] Continuation of Ser. No. 866,259, Apr. 19, 1992, Pat. No. 5,219,392, which is a continuation of Ser. No. 422,076, Apr. 17, 1989, abandoned, which is a continuation of Ser. No. 129,430, Nov. 25, 1987, abandoned, which is a continuation of Ser. No. 810,253, Dec. 18, 1985, abandoned.

[51] Int. Cl.[6] ..... B25B 13/06

[52] U.S. Cl. ..... 81/124.3; 81/121.1

[58] Field of Search ..... 81/119, 121.1, 124.3, 81/124.6, DIG. 5

[56] References Cited

U.S. PATENT DOCUMENTS

| | | |
|---|---|---|
| 3,027,790 | 4/1962 | Wagner . |
| 3,079,819 | 3/1963 | Wing . |
| 3,125,910 | 3/1964 | Kavalar . |
| 3,495,485 | 4/1966 | Knudsen . |
| 3,675,516 | 7/1972 | Knudsen et al. . |
| 3,695,124 | 10/1972 | Myers . |
| 3,916,736 | 8/1974 | Clemens . |
| 3,948,120 | 4/1976 | Hancock . |
| 4,100,824 | 7/1978 | Marschke . |
| 4,512,220 | 4/1985 | Barnhill, III et al. . |
| 4,598,616 | 9/1985 | Colvin . |
| 4,646,594 | 3/1987 | Tien . |

FOREIGN PATENT DOCUMENTS

| | | |
|---|---|---|
| 0156681 | 2/1985 | European Pat. Off. . |
| 1033792 | 4/1953 | France . |
| 1088437 | 9/1960 | Germany . |
| 508761 | 8/1939 | United Kingdom . |
| 1464808 | 2/1977 | United Kingdom . |

*Primary Examiner*—D. S. Meislin

*Attorney, Agent, or Firm*—Fredrikson & Byron

[57] ABSTRACT

Rotary wrenching tools are sized, in one embodiment, to strongly and adequately receive heads of fastening members of two or more nominal sizes having maximum size ratios in the approximate size ranges of 1.0053–1.1430 for square heads and 1.0053–1.0600 for hexagonal heads. Visible indicia of the sizes of at least two different fastener head sizes are carried adjacent each opening.

25 Claims, 6 Drawing Sheets

Fig.21
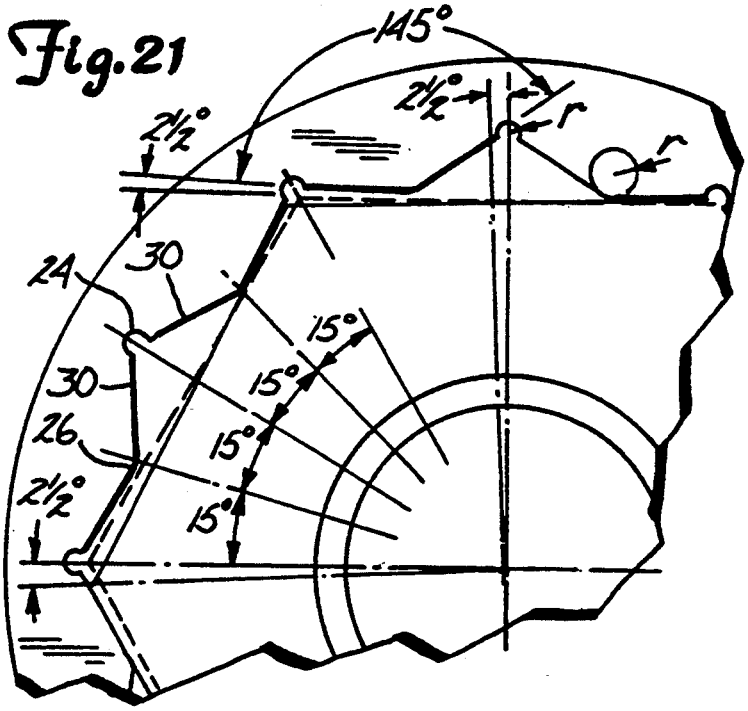
Fig.22
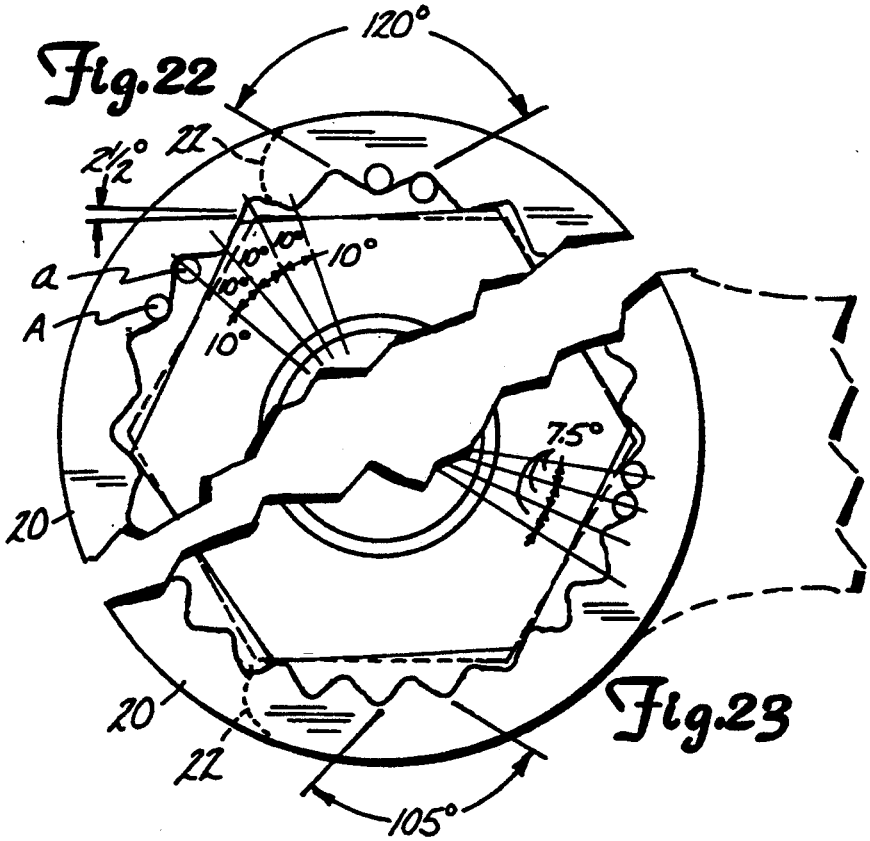
Fig.23

Fig.24
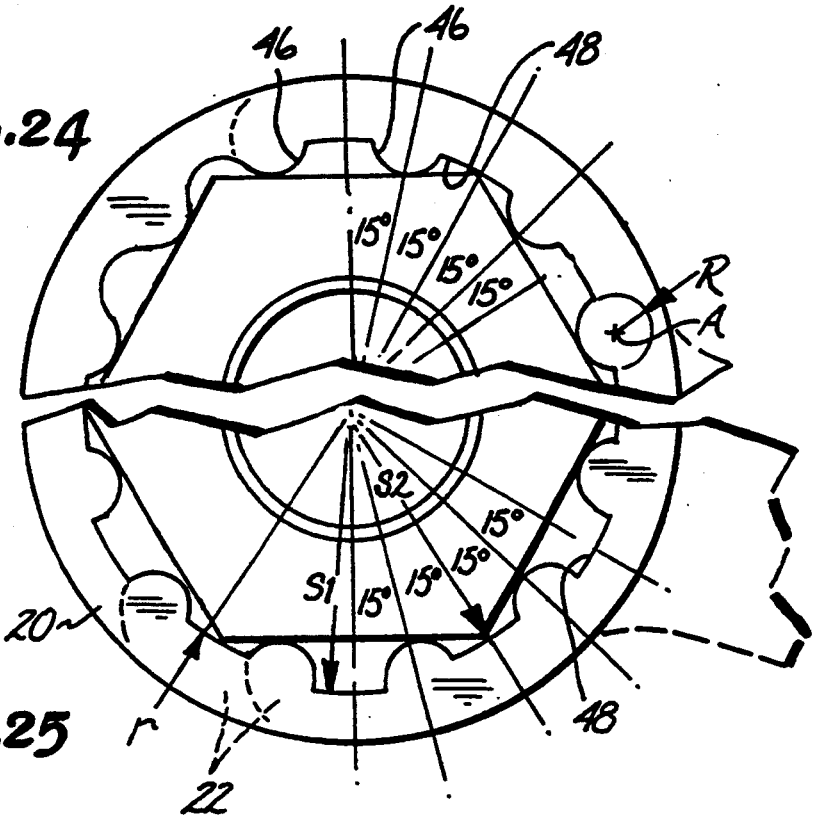
Fig.25
Fig.26
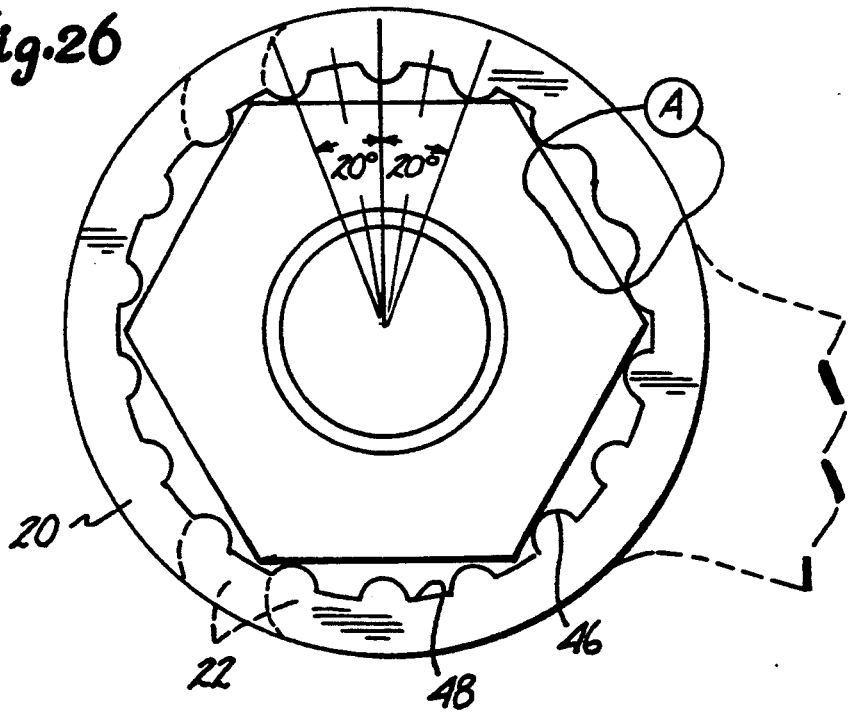

ROTARY WRENCHING TOOL

RELATED APPLICATIONS

This application is a continuation of application Ser. No. 07/866,259, filed Apr. 19, 1992, now U.S. Pat. No. 5,219,392, which is a continuation of Ser. No. 07/422,076, filed Apr. 17, 1989 (abandoned), which is a continuation of Ser. No. 07/129,430, filed Nov. 25, 1987 (abandoned), which is a continuation of Ser. No. 06/810,253, filed Dec. 18, 1985 (abandoned).

FIELD OF THE INVENTION

This invention relates to rotary tools of the type used in rotating or "wrenching" fasteners such as bolts and screws having polygonal (e.g., square or hexagonal) heads. The invention particularly relates to tools capable of wrenching fastener heads designed, sized or marked in various measuring systems such as the metric system, the English or inch system such as tile American fractional system (AF and SAE), and the British systems such as BA, BS and Whitworth (W).

BACKGROUND OF THE INVENTION

Many countries have adopted tile metric measuring system for tile manufacture of bolts, screws: nuts and wrenches. Such countries as France. Germany, Italy, Japan, Czechoslovakia and Russia today almost exclusively utilize the metric system for such manufactures. The United States, Canada, England, Australia, New Zealand and the like, use measuring systems based upon both the English (inch) and metric measuring systems.

National standards or specifications have been adopted by many technically developed countries for sockets and other wrenches. These standards, which differ at least in part from one another, include SAE, ASTM, MIL, GGG-W, BS, FS, DIN, JS, CSN, JUS, and COST. No uniform international standard has yet been accepted, although more than fifteen years have been devoted to the effort to reach a standard acceptable to all technically developed countries. Great Britain, for example, presently uses up to six different systems for marking spanners, sockets and other wrenches. The United States predominantly uses tile English (inch) system (AF, ANSI, MIL and SAE) and, to some extent, the metric system (millimeters). The diversity in such standards has limited the development of new types of bolts, nuts and wrenching tools. Periodic reviews and revisions of such standards have not produced the necessary changes to cover rapid development of a new type of wrenches, and the issuance of new, updated standards often takes over fifteen years. Consequently, a vast number of different wrenching tools of various designs, openings and tolerances are manufactured throughout the world. A user is subjected to a never-ending inventory of wrenching tools to accommodate all of the sizes and measuring systems in existence today. This is costly and inconvenient for individuals and for industry in general.

One attempt to simplify this situation is found in U.S. Pat. No. 4,100,824 which describes a wrench with a non-uniform interior configuration having one set of grooves sized in tile English system and another set of grooves sized in the metric system. This patent does not address the problems created through tile use of various additional measuring systems. Care needs to be taken with this system to insert the bolt or nut head in the correct set of grooves, and this wrenching system moreover generally is not suitable for use in impact or power sockets or in open end wrenches and British sized spanners and sockets.

U.S. Pat. No. 3,027,790 discloses a wrench having several moving parts as adaptors and does not appear to represent a practical solution to the problem, since professionals and serious amateurs appear to prefer solid one-piece wrenching tools with no extraneous parts.

It would be desirable to provide simplified rotary wrenching tools having the ability to drive one or more and, desirably, up to six different sizes of fasteners, and wrenches having better performance in bearing action in tightening or loosening fasteners without damage to either the tool or the fastener.

SUMMARY OF THE INVENTION

The invention in one embodiment provides simple, single piece rotary wrenching tools having uniform interior configurations and no moving parts and which are specifically sized the turning fasteners (nuts, screws, bolts, etc.) having square, hexagonal or other polygonal heads such that one tool size is capable of strongly and adequately fitting polygonal heads nominally sized in at least two and up to six different nominal sizes and up to seven different system markings. By "rotary tool", "spanner" or "wrench", as used herein, reference is made to tools having openings which completely or partially encircle or encompass the polygonal heads of threaded fasteners such as bolts and screws to rotate the fasteners. Thus, such tools may be of tile socket variety in which the rotary tool opening completely encircles the head of tile threaded member and is moved into such position axially of the threaded member, or may be of tile spanner or open-end wrench variety in which tile rotary tool opening only partially encircles the head of the threaded member and may be moved into its wrenching position in a direction generally normal to the axis of the threaded member. Rotary tools include such tools as may commonly be referred to as socket wrenches, box-end spanners, ratcheting box-end, open end, nut drivers, flare-nut, lug-nut, crowfoot and combination wrenches, impact and power socket wrenches, flex-head wrenches, etc.

In this first mentioned embodiment, wrenching tools which are adapted for use with threaded members having square heads are so sized as to accommodate maximum and minimum sized square-headed members such that the maximum ratio of the nominal distance across opposing flats of such maximum and minimum square-headed members ranges from about 1.0053 to about 1.1430. Similarly, in this first-mentioned embodiment, wrenching tools which are adapted for use with threaded members having hexagonal heads are so sized as to accommodate maximum and minimum sized hexagonal headed members such that the maximum ratio of the nominal distance across opposing flats about of such maximum and minimum sized members ranges from about 1.0053 to about 1.0600. Further, such wrenching tools desirably have inner, lead-confronting surfaces contoured to provide recesses positioned opposite comers of the fastener heads so as to avoid contact between the tool and the head comers. Visible indicia are carried adjacent each wrench opening, such indicia comprising at least two and preferably three or more specific but different nominal sizes in at least two different sizing systems.

In a second embodiment, a rotary wrenching tool of the invention is provided with a uniquely configured opening for receiving a polygonal head of a threaded member. The opening may have an axis of rotation and an inner surface comprising a series of spaced arcuate first surfaces concave to the axis of the opening, each such first surface being defined generally as tile locus of points falling a given radial distance r from a first axis itself spaced a distance $r_1$ from, but parallel to, the axis of tile opening, and a series of arcuate second surfaces convex to the axis of the opening and spaced about the circumference of the opening, each such second surface being defined generally as the locus points falling a radial distance R from a second axis spaced itself a distance $R_1$ from, but parallel to, the axis of the opening. Each surface that forms a portion of the inner surface and that is contiguous to an arcuate surface preferably tangentially merges into that arcuate surface. Desirably, the relationship of r and R is such that if r equals R, the wrench includes surface means providing flat surfaces between and tangentially intersecting the first and second surfaces. $R_1$ desirably is larger than $r_1$, and in the case where each second axis is angularly spaced from at least one next adjacent second axis by 600, the ratio $R_1/r_1$ desirably exceeds 1.5 and preferably exceeds 2.0. In this case also, R is desirably equal to or greater than r, and the ratio R/r preferably exceeds about 5.0. Also in this embodiment in which each second axis is angularly spaced by 60° from at least one next adjacent second axis, the adjacent arcuate surfaces preferably merge tangentially into one another.

The second axes of the embodiments described above may, if desired, be spaced from one another by 45° or by 90° to thereby provide an opening accommodating square heads of threaded members. The wrench opening may be provided with a plurality of circumferentially extending surface portions that may intersect at sharp angles, e.g., approximately at right angles, with the inwardly convex arcuate surfaces. Further, inwardly convex arcuate surfaces of different sizes may be interspersed with one another.

The rotary wrenching tools of this second embodiment preferably have head-contacting interiors sized to strongly and adequately grip polygonal fastener heads sized in two, preferably three, and up to six different nominal sizes. The ratio (determined as described above) for tools of this second embodiment accepting square heads ranges from 1.0001 to about 1.1430 and for tools accepting hexagonal heads ranges from 1.0001 to about 1.0600. Also, as the wrench opening sizes are varied (FIGS. 8, 9, 14, 17, 18, 19, 20, 21), the included angle between adjacent flats preferably is also varied to better accommodate fastener heads sized in different sizing systems.

DESCRIPTION OF THE DRAWING

FIG. 21 is a broken-away plan view of a novel twelve-contact point wrenching system for hexagonal bolt heads;

FIG. 22 is a broken-away plan view of a novel eighteen-contact point drive wrenching system for turning hexagonal bolt heads;

FIG. 23 is a broken-away plan view of a novel twenty-four-contact point drive wrench;

FIG. 24 is a broken-away plan view of a novel twelve-contact point drive, preferably open-end wrench for hexagonal bolt heads;

FIG. 25 is a broken-away plan view of a novel wrench having six contact points sized in one measuring system and six contact points sized in another; and FIG. 26 is a broken-away plan view of a novel eighteen-contact point drive wrench.

DESCRIPTION OF PREFERRED EMBODIMENTS

Figure 1:
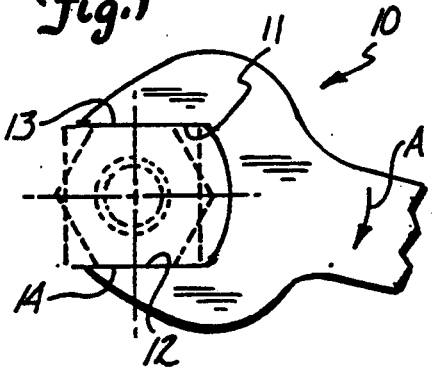
FIG. 1 is a broken-away plan view of a conventional two-contact point drive wrench, the wrench flats making contact with comers of a square or hexagonal bolt head as shown in phantom lines.
Figure 2:
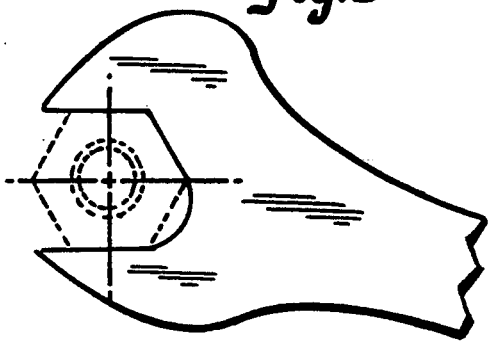
FIG. 2 is a broken-away plan view of a conventional three-contact point drive wrench similar to that of FIG. 1.
Figure 5:
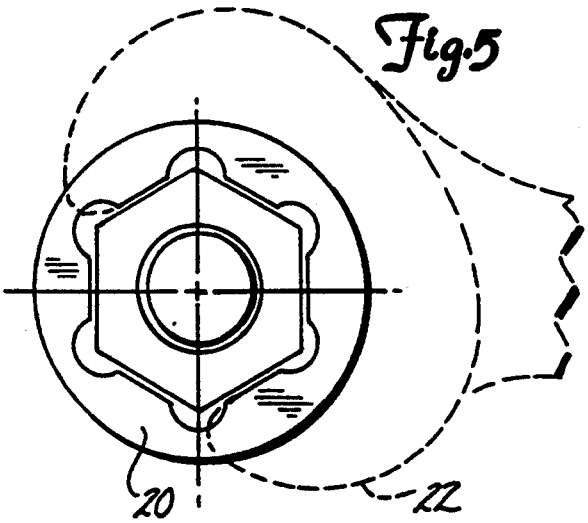
FIG. 5 is a broken-away plan view of a conventional six-driving point wrench described in British Patent 508,761 for use with hexagonal bolt heads and which avoids contact with comers of a bolt head,and which can be sized in accordance with the present invention.
Figure 6:
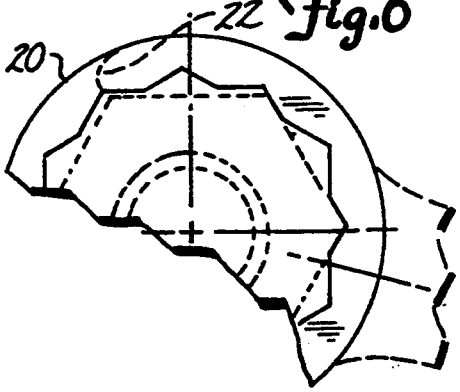
FIG. 6 is a broken-away plan view of a conventional twelve-contact point drive wrench for turning hexagonal headed bolts.

To aid in understanding the concept of rotary wrenching tools in general, a brief explanation is desirable of the contact that occurs between the working surfaces of a rotary wrenching tool and a nut or bolt head. With reference to FIG. 1, for example, the wrench (10) has wrench flats (11), (12) which are spaced apart a sufficient distance to loosely accommodate the confronting flat surfaces (13), (14) of a hexagonal bolt, shown in phantom lines. If the wrench is turned in the direction of arrow A, it will be understood that the wrench flats bear against the comers of the bolt head, rather than upon the flat surfaces of the bolt head; this is referred to as comer contact", and use of wrenches of this type can readily score and round the comers of bolt heads, particularly hexagonal bolt heads. With wrenches of the type shown in FIG. 7, on the other hand, the interior surface of the wrench opening makes contact not with the comers of the bolt head but rather at points (actually, lines) along the length of the flat bolt head edges. The rounded lobes (15) of the wrench (16) initially make line contact with the bolt head, but as pressure is applied, the bolt head edges are deformed slightly so that contact between the lobes and the bolt head occurs over a broader surface. Although certain wrench configurations, such as that depicted in FIG. 8, have been advertised as providing "flat-to-flat" surface contact with hexagonal bolt heads, it will be understood that tolerances in the manufacture of both the wrench and the bolt heads prevent such contact from in fact being along the full surface of the wrench flats, such contact being in fact a line contact until the bolt head is suitably deformed by sharp edges of the wrench. Note that the wrench of FIG. 8, in a manner similar to that shown in FIG. 5, employs recessed portions to accommodate corners edges of fastener heads to thereby avoid comer contact with the heads.

Figure 7:
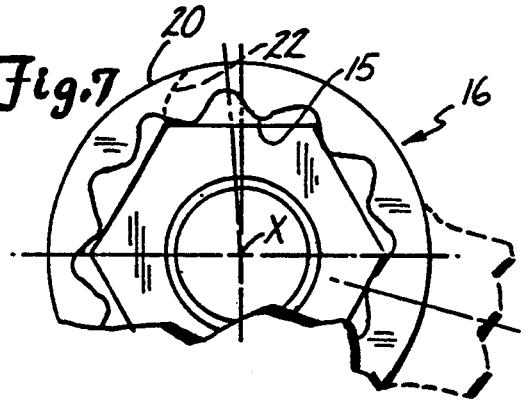
FIG. 7 is a broken-away plan view of a twelve-contact point wrench designed to contact hexagonal bolt heads without comer contact, of the type described in U.S. Pat. No. 3,125,910, which wrench can be sized in accordance with the present invention.
Figure 10:
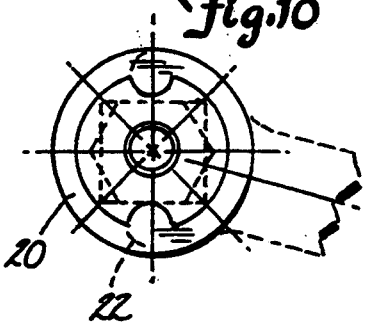
FIG. 10 is a broken-away plan view of a two-contact point wrench driving square and hexagonal nuts, and which can be sized in accordance with the instant invention.
Figure 8:
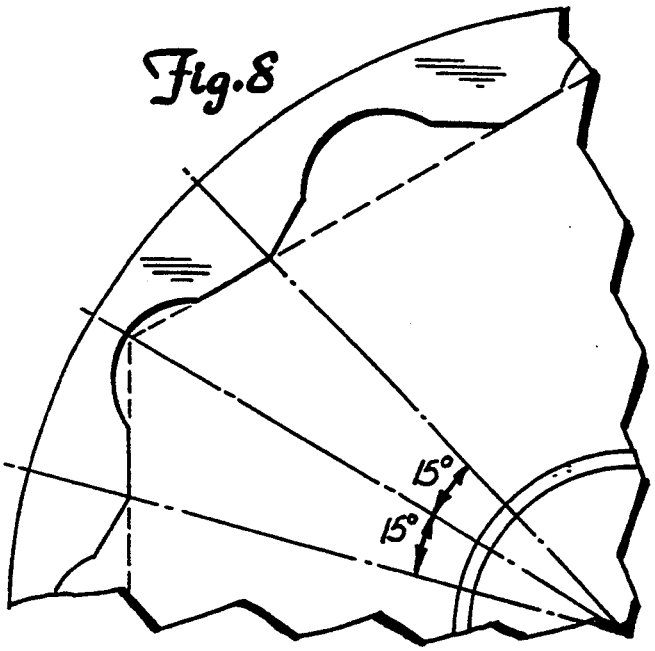
FIG. 8 is a broken-away plan view of a twelve-point drive wrench which does not contact comers of a hexagonal bolt, one type of which is shown in U.S. Pat. Nos. 3,272,430 and 3,495,485, which wrench can be sized in accordance with the present invention.
Figure 11:
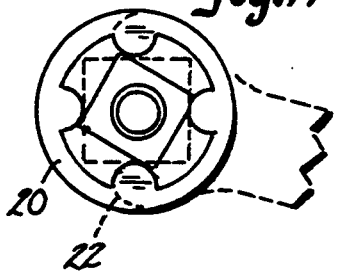
FIG. 11 is a broken-away plan view of a four-contact point wrench similar to that of FIG. 10 and which can be sized in accordance with the present invention.
Figure 12:
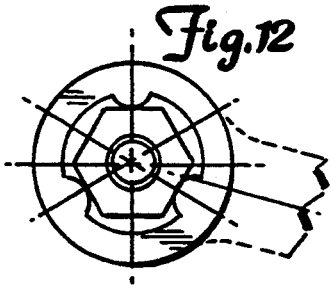
FIG. 12 is a broken-away plan view of a three-contact point wrench of the type described in U.S. Pat. No. 3,695,124, used for hexagonal bolt heads and, which does not contact the comers of the heads, in a manner similar to that shown in FIGS. 10 and 11, and which wrench can be sized in accordance with the present invention.
Figure 9:
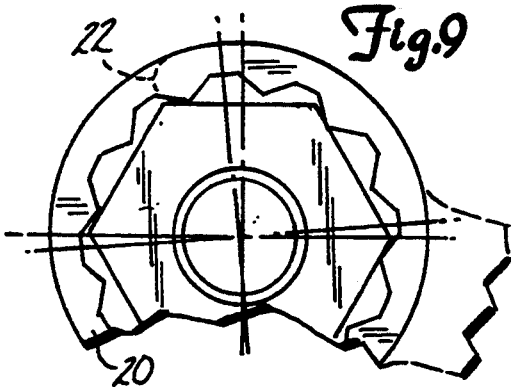
FIG. 9 is a broken-away plan view of a twelve-contact point wrenching system of the type shown in U.S. Pat. No. 3,079,819 which can be sized in accordance with the present invention.
Figure 13:
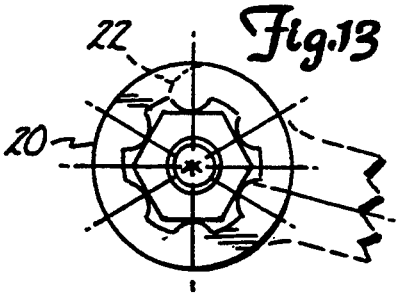
FIG. 13 is a broken-away plan view of a six-contact point drive wrench used for hexagonal bolt heads and which does not contact the comers of the heads, which wrench can be sized in accordance with the present invention.

With reference to the tools exemplified in the drawing (except FIG. 25), such tools are characterized as having uniform interior configuration. That is, similarly configured interior surface elements (e.g., lobes) are radially spaced the same distance from the axis of the wrenching tool opening. For example, the lobes (15) depicted in FIG. 7 are equally radially spaced from the axis X. In contrast, the circumferential surface portions (48) shown in FIG. 25 are spaced unequally radially from the axis X, as will be described more fully below.

With reference to one embodiment of the invention, rotary wrenching tools are provided which have no moving pans and which are specifically sized for turning fasteners such as nuts, screws and bolts that have square, hexagonal or other polygonal heads. These wrenching tools are characterized by being capable of strongly and adequately fitting polygonal heads nominally sized in at least two different systems such as, for example, the American Fractional standard ("AF") and the British Standards ("BS", for example), and of carrying at least two and preferably three or more suitable size markings in different size systems. That is, the rotary wrenching tools of the invention fit polygonal fastener heads such that scoring or rounding of the heads does not occur even when substantial wrenching torque is applied thereto. Such strong and adequate fitting of the tool to the head of the fastener is such that the application of excessive substantial wrenching torque is more apt to cause physical breakage of the fastener head from the threaded stem of the fastener, or simply cause the deformation ("stripping") of the stem threads. Of particular importance to this embodiment of the invention are those wrenches which have head-confronting surfaces that are contoured to provide recesses opposite comers of the heads to thereby avoid contact with the head Comers. Most preferably, the head-confronting surfaces of the rotary tool are provided with inwardly protruding, rounded lobes positioned to encounter the head of a fastening member along flat surfaces of the head, rather than at its comers, the lobe, upon the application of substantial torque, tending to slightly deform the flat surfaces of the head to provide surface-to-surface contact between the wrench and head.

The driving heads of bolts and similar fastening members can be sized in the metric system (e.g., ram) and also in inches using American Fractional ("AF") standards (SAE, MIL, etc.) and British standards such as "BS", "BA" and "W" (Whitworth) measurements. The wrenches of this embodiment of the invention are sized so as to strongly and adequately accommodate fastener heads of at least two different nominal sizes such that the ratio of the nominal distances across opposing head surfaces falls, in the case of square heads, within the range of about 1.0053 to about 1.1430, and, in the case of hexagonal heads, with the range of about 1.0053 to about 1.060.0.

Table I set out below provides a non-inclusive, exemplary list of nominal head openings and size combinations for square and hexagonal head fasteners. Referring, for ease of explanation, to the first entry in the table, this entry describes a wrench which will fully and adequately engage the polygonal head of a threaded fastener that has the nominal dimensions of 1.5 mm & 1/16 (AF, U.S. standard) & 16 BA (British standard). As shown in the table, 1/16 inches converts to 1.5875 millimeters. 16 BA, in the British standard, corresponds to 1.4224 mm. 1.5 mm, in the metric system, is, of course, 1.5 mm. The maximum ratio of the maximum nominal distance across flats (1.5875) to the minimum nominal distance across flats (1.4224) is 1.1161, and this is recorded in the final column of the table. As further explanation, the last entry in the table refers to a fastener head having a nominal distance across opposing flats of 220 mm. The wrench of the invention, suitably sized, also fully and adequately fits fastener heads sized in the U.S. American Fractional system as 8 ⅝" & 8 ¾". The latter nominal values correspond to 219.0731 mm and 222.2481 mm, respectively. The maximum ratio of the maximum nominal size to the minimum nominal size hence is 222.2481/219.0731, or 1.0145. The ratios thus referred to are calculated according to the following formula:

$$\text{Ratio} = \frac{\text{maximum nominal head size in millimeters}}{\text{minimum nominal head size in millimeters}}$$

TABLE I

WRENCH MARKINGS AND SIZE COMBINATIONS FOR SQUARE AND HEXAGONAL NUTS AND BOLT AND SCREW HEADS

| Nominal Head Dimensions and Size Combinations | | | | | | | | | | |
|---|---|---|---|---|---|---|---|---|---|---|
| | | ENGLISH in INCHES | | | | | | | | |
| | | | | British Standard | | | Nominal Size in MM | | | |
| METRIC in MM | | US Standard AF & SAE | | BA | W Whit-Worth | BS | US Standard AF & SAE | British BA | Standard W & BS | RATIO Maximum |
| 1.5 & | — | 1/16 & | — | 16BA | — | — | 1.5875 | 1.4224 | — | 1.1161 |
| 1.5 & | — | 1/16 | — | — | — | — | 1.5875 | — | — | 1.0583 |
| 1.5 & | — | — | — | 16BA | — | — | — | 1.4224 | — | 1.0546 |
| — | — | 1/16 & | — | 16BA | — | — | 1.5875 | 1.4224 | — | 1.1161 |
| 1.5 & | — | 1/16 & | — | 15BA | — | — | 1.5875 | 1.5748 | — | 1.0583 |
| 1.5 & | — | — | — | 15BA | — | — | — | 1.5748 | — | 1.0498 |
| — | — | 1/16 & | — | 15BA | — | — | 1.5875 | 1.5748 | — | 1.0081 |
| — | — | 1/16 & | — | 14BA | — | — | 1.5875 | 1.7526 | — | 1.1040 |
| 2 & | — | 5/64 & | — | 14BA | — | — | 1.9844 | 1.7526 | — | 1.1412 |
| 2 & | — | 5/64 & | — | — | — | — | 1.9844 | — | — | 1.0079 |
| — | — | 5/64 & | — | 14BA | — | — | 1.9844 | 1.7526 | — | 1.1323 |
| 2 & | — | | — | 14BA | — | — | — | 1.7526 | — | 1.1412 |
| 2 & | — | 5/64 & | — | 13BA | — | — | 1.9844 | 2.1082 | — | 1.0624 |
| 2 & | — | — | — | 13BA | — | — | — — | 2.1082 | — | 1.0541 |
| — | — | 5/64 & | — | 13BA | — | — | 1.9844 | 2.1082 | — | 1.0624 |
| 2 & | — | — | — | 12BA | — | — | — | 2.2860 | — | 1.1430 |
| 2.5 & | — | 3/32 & | — | 12BA | — | — | 2.3812 | 2.2860 | — | 1.0936 |
| 2.5 & | — | 3/32 | — | — | — | — | 2.3812 | — | — | 1.0499 |
| 2.5 & | — | — | — | 12BA | — | — | — | 2.2860 | — | 1.0936 |
| — | — | 3/32 & | — | 12BA | — | — | 2.3812 | 2.2860 | — | 1.0416 |
| 2.5 & | — | 3/32 & | — | 11BA | — | — | 2.3812 | 2.6162 | — | 1.0987 |
| 2.5 & | — | — | — | 11BA | — | — | — | 2.6162 | — | 1.0465 |
| — | — | 3/32 & | — | 11BA | — | — | 2.3812 | 2.6162 | — | 1.0987 |
| 3 & | — | 7/64 & | — | 10BA | — | — | 2.7781 | 2.9718 | — | 1.0799 |
| 3 & | — | 7/64 | — | — | — | — | 2.7781 | — | — | 1.0799 |
| 3 & | — | — | — | 10BA | — | — | — | 2.9718 | — | 1.0095 |
| — | — | 7/64 & | — | 10BA | — | — | 2.7781 | 2.9718 | — | 1.0691 |
| 3.2 & | 3 & | ⅛ | — | — | — | — | 3.1750 | — | — | 1.0667 |
| 3.2 & | — | ⅛ & | — | 9BA | — | — | 3.1750 | 3.3274 | — | 1.0480 |
| 3.2 & | — | ⅛ | — | — | — | — | 3.1750 | — | — | 1.0079 |
| 3.2 & | — | — | — | 9BA | — | — | — | 3.3274 | — | 1.0398 |
| — | — | ⅛ & | — | 9BA | — | — | 3.1750 | 3.3274 | — | 1.0480 |
| 3.5 & | — | 9/64 & | — | 9BA | — | — | 3.5718 | 3.3274 | — | 1.0735 |
| 3.5 & | — | 9/64 | — | — | — | — | 3.5718 | — | — | 1.0205 |
| 3.5 & | — | — | — | 9BA | — | — | — | 3.3274 | — | 1.0519 |
| — | — | 9/64 & | — | 9BA | — | — | 3.5718 | 3.3274 | — | 1.0735 |
| 4 & | — | 5/32 & | — | 8BA | — | — | 3.9687 | 3.8608 | — | 1.0363 |
| 4 & | — | 5/32 | — | — | — | — | 3.9687 | — | — | 1.0079 |
| 4 & | — | — | — | 8BA | — | — | — | 3.8608 | — | 1.0363 |
| — | — | 5/32 & | — | 8BA | — | — | 3.9687 | 3.8608 | — | 1.0282 |
| 4.5 & | — | 3/16 & | — | 7BA | — | — | 4.7625 | 4.3688 | — | 1.0898 |
| 4.5 & | — | 3/16 | — | — | — | — | 4.7625 | — | — | 1.0583 |
| 4.5 & | — | — | — | 7BA | — | — | — | 4.3688 | — | 1.0297 |
| — & | — | 3/16 & | — | 7BA | — | — | 4.7625 | 4.3688 | — | 1.0898 |
| 4.8 & | — | 3/16 & | — | 6BA | — | — | 4.7625 | 4.9021 | — | 1.0290 |
| 4.8 & | — | 3/16 & | — | — | — | — | 4.7625 | — | — | 1.0079 |
| 4.8 & | — | | — | 6BA | — | — | — | 4.9021 | — | 1.0213 |
| — | — | 3/16 & | — | 6BA | — | — | 4.7625 | 4.9021 | — | 1.0289 |
| 5 & | — | 3/16 & | — | 6BA | — | — | 4.7625 | 4.9021 | — | 1.0499 |
| 5 & | — | 3/16 | — | — | — | — | 4.7625 | — | — | 1.0499 |
| — | — | 3/16 & | — | 6BA | — | — | 4.7625 | 4.9021 | — | 1.0289 |
| 5 & | — | — | — | 6BA | — | — | — | 4.9021 | — | 1.0204 |
| 5 & | — | 13/64 & | — | 6BA | — | — | 5.1593 | 4.9021 | — | 1.0529 |
| 5 & | — | 13/64 | — | — | — | — | 5.1593 | — | — | 1.0319 |
| — | — | 13/64 & | — | 6BA | — | — | 5.1593 | 4.9021 | — | 1.0529 |
| 5.5 & | — | 7/32 & | — | 5BA | — | — | 5.5562 | 5.5888 | — | 1.0164 |
| 5.5 & | — | 7/32 & | — | — | — | — | 5.5562 | — | — | 1.0102 |
| 5.5 & | — | — | — | 5BA | — | — | — | 5.5888 | — | 1.0164 |
| — | — | 7/32 | — | 5BA | — | — | 5.5562 | 5.5888 | — | 1.0061 |
| 6 & | — | ¼ | — | — | — | — | 6.3499 | — | — | 1.0583 |
| 6 & | — | ¼ & | — | 4BA | — | — | 6.3499 | 6.2991 | — | 1.0583 |
| 7 & | — | 9/32 | — | — | — | — | 7.1437 | — | — | 1.0205 |
| 7 & | — | 9/32 & | — | 3BA | 3/32W & | ⅛BS | 7.1437 | 7.1627 | 7.5437 | 1.0777 |
| 8 & | — | 5/16 | — | — | — | — | 7.9374 | — | — | 1.0079 |
| 8 & | — | 5/16 & | — | 2BA | — | — | 7.9374 | 8.2295 | — | 1.0368 |
| 9 & | — | 11/32 | — | — | — | — | 8.7312 | — | — | 1.0308 |
| 9 & | — | — | — | — | ⅛W & | 3/16BS | — | — | 8.6359 | 1.0422 |
| 9 & | — | ⅜ & | — | 1BA | — | — | 9.5249 | 9.2709 | — | 1.0583 |
| 9 & | — | ⅜ | — | — | — | — | 9.5249 | — | — | 1.0583 |

TABLE I-continued

WRENCH MARKINGS AND SIZE COMBINATIONS FOR SQUARE AND HEXAGONAL NUTS AND BOLT AND SCREW HEADS

| Nominal Head Dimensions and Size Combinations | | | | | | | | | | |
|---|---|---|---|---|---|---|---|---|---|---|
| | | ENGLISH in INCHES | | | | | | | | |
| | | | | British Standard | | | Nominal Size in MM | | | |
| METRIC in MM | | US Standard AF & SAE | | BA | W Whit-Worth | BS | US Standard AF & SAE | British BA | Standard W & BS | RATIO Maximum |
| 10 & | — | ⅜ & | — | — | — | — | 9.5249 | — | — | 1.0499 |
| 10 & | — | 13/32 & | — | 0BA | — | 7/32BS | 10.3187 | 10.4901 | 10.4901 | 1.0490 |
| 11 & | — | 7/16 | — | — | — | — | 11.1124 | — | — | 1.0102 |
| 11 & | — | 7/16 & | — | 0BA | — | — | 11.1124 | 10.4901 | — | 1.0593 |
| 11 & | — | 7/16 & | — | — | 3/16W & | ¼BS | 11.1124 | — | 11.3029 | 1.0275 |
| 12 & | — | 15/32 | — | — | — | — | 11.9061 | — | — | 1.0079 |
| 13 & | — | ½ | — | — | — | — | 12.6999 | — | — | 1.0236 |
| 13 & | — | ½ & | — | — | ¼W & | 5/16BS | 12.6999 | 13.3349 | 13.3349 | 1.0500 |
| 14 & | — | 9/16 & | — | — | ¼W & | 5/16BS | 14.2874 | 13.3349 | 13.3349 | 1.0714 |
| 14 & | — | 9/16 & | — | — | — | — | 14.2874 | — | — | 1.0205 |
| 15 & | — | 19/32 | — | — | — | — | 15.0811 | — | — | 1.0054 |
| 15 & | — | 19/32 & | — | — | 5/16W & | ⅜BS | 15.0811 | — | 15.2399 | 1.0160 |
| 16 & 15 & | 14 & | 9/16 & | ⅝ & | — | 5/16W & | ⅜BS | 14.2874<br>15.8749 | — | 15.2399 | 1.1429 |
| 16 & | — | ⅝ & | — | — | 5/16W & | ⅜BS | 15.8749 | 15.2399 | 15.2399 | 1.0499 |
| 17 & | — | 11/16 & | — | — | — | — | 17.4623 | — | — | 1.0272 |
| 17 & | 16 | — | — | — | — | — | — | — | — | 1.0625 |
| 18 & | 17 | — | — | — | — | — | — | — | — | 1.0588 |
| 18 & | — | 23/32 & | — | — | ⅜W & | 7/16BS | 18.2561 | — | 18.0338 | 1.0142 |
| 19 & | 18 | — | — | — | — | — | — | — | — | 1.0556 |
| 19 & | — | ¾ & | — | — | ⅜W & | 7/16BS | 19.0498 | — | 18.0338 | 1.0563 |
| 20 & | — | 25/32 & | — | — | 7/16W & | ½BS | 19.8436 | — | 20.8278 | 1.0496 |
| 20 & | 19 | — | — | — | — | — | — | — | — | 1.0526 |
| 20 & | 19 & | ¾ | — | — | — | — | 19.0498 | — | — | 1.0526 |
| 21 & | 20 | 13/16 | — | — | — | — | 20.6373 | — | — | 1.0500 |
| 21 & | — | 13/16 & | — | — | 7/16W & | ½BS | 20.6373 | — | 20.8278 | 1.0176 |
| 22 & | 21 | — | — | — | — | — | — | — | — | 1.0476 |
| 22 & | — | ⅞ & | — | — | — | — | 22.2248 | — | — | 1.0102 |
| 23 & | — | ⅞ | — | — | ½W & | 9/16BS | 22.2248 | — | 23.3678 | 1.0514 |
| 23 & | — | ⅞ | — | — | — | — | 22.2248 | — | — | 1.0349 |
| 23 & | 22 & | ⅞ | — | — | — | — | 22.2248 | — | — | 1.0455 |
| 24 & | — | 15/16 | — | — | — | — | 23.8123 | — | — | 1.0079 |
| 24 & | — | 15/16 & | — | — | ½W & | 9/16BS | 23.8123 | — | 23.3678 | 1.0271 |
| 24 & | 23 & | 15/16 | — | — | ½W & | 9/16BS | 23.8123 | — | 23.3678 | 1.0435 |
| 25 & | — | 1 | — | — | — | — | 25,3998 | — | — | 1.0160 |
| 25 & | — | 1 | — | — | 9/16W & | ⅝BS | 25.3998 | — | 25.6538 | 1.0262 |
| 25 & | 24 & | 15/16 & | 1 & | — | 9/16W & | ⅝BS | 23.8123 | — | 25.6538 | 1.0773 |
| 26 & | 25 | 1 1/32 | 1 | — | 9/16W & | ⅝BS | 26.1935<br>25.3998 | — | 25.6538 | 1.0477 |
| 27 & | — | 1 1/16 | — | — | ⅝W & | 11/16BS | 26.9873 | — | 27.9398 | 1.0353 |
| 27 & | 26 & | 1 1/16 & | 1 1/32 | — | — | — | 26.9873<br>26.1935 | — | — | 1.0385 |
| 27 & | — | 1 1/16 | — | — | — | — | 26.9873 | — | — | 1.0005 |
| 28 & | — | 1⅛ | — | — | — | — | 28.5748 | — | — | 1.0205 |
| 28 & | 27 | — | — | — | — | — | — | — | — | 1.0370 |
| 28 & | 27 & | 1⅛ & | 1 1/16 & | — | ⅝W & | 11/16BS | 28.5748<br>26.9873 | — | 27.9398 | 1.0588 |
| 29 & | — | 1⅛ & | — | — | ⅝W | 11/16BS | 28.5748 | — | 27.9398 | 1.0379 |
| 30 & | — | 1 3/16 & | — | — | 11/16W & | ¾BS | 30.1622 | — | 30.4797 | 1.0105 |
| 30 & | — | 1 3/16 | — | — | — | — | 30.1622 | — | — | 1.0054 |
| 30 & | 29 & | 1⅛ & | 1 3/16 | — | — | — | 28.5748<br>30.1622 | — | — | 1.0556 |
| 31 & | — | 1¼ | — | — | — | — | 31.7497 | — | — | 1.0242 |
| 31 & | 30 & | 1¼ & | 1 3/16 & | — | 11/16W & | ¾BS | 31.7497 | — | 30.4797 | 1.0583 |
| 31 & | 30 & | 1¼ & | 1 3/16 | — | — | | 30.1622 | — | — | 1.0583 |
| 32 & | — | 1¼ | — | — | — | — | 31.7497 | — | — | 1.0079 |
| 32 & | 31 & | 1¼ | — | — | — | — | 31.7497 | — | — | 1.0323 |
| 32 & | — | 1¼ & | — | — | ¾W & | ⅞BS | 31.7497 | — | 33.0197 | 1.0400 |
| 33 & | 32 & | 1 5/16 & | 1¼ & | — | ¾W & | ⅞BS | 33.3372<br>31.7497 | — | 33.0197 | 1.0500 |
| 34 & | — | 1⅜ & | — | — | 13/16W | 15/16BS | 34.9247 | — | 35.3057 | 1.0384 |
| 35 & | 34 & | 1⅜ & | 1 5/16 & | — | 13/16W & | 15/16BS | 34.9247<br>33.3372 | — | 35.3057 | 1.0591 |
| 36 & | 35 & | 1 7/16 | — | — | 13/16W & | 15/16BS | 35.5122 | — | 35.3057 | 1.0286 |
| 37 & | — | 1½ | — | — | — | — | 38.0997 | — | — | 1.0297 |
| 38 & | — | 1½ | — | — | — | — | 38.0997 | — | — | 1.0026 |
| 38 & | 37 & | 1½ | — | — | ⅞W & | 1BS | 38.0997 | — | 37.5917 | 1.0297 |
| 39 & | — | 1 9/16 | — | — | — | — | 39.6872 | — | — | 1.0176 |
| 40 & | — | 1 9/16 | — | — | — | — | 39.6872 | — | — | 1.0079 |
| 41 & | — | 1⅝ & | 1 11/16 | — | 1W & | 1⅛BS | 41.2746<br>42.8621 | — | 42.4176 | 1.0454 |
| 42 & | — | 1 11/16 | — | — | — | — | 42.8621 | — | — | 1.0205 |
| 43 & | — | 1 11/16 | — | — | — | — | 42.8621 | — | — | 1.0032 |
| 44 & | — | 1¾ | — | — | — | — | 44.4496 | — | — | 1.0102 |

TABLE I-continued

WRENCH MARKINGS AND SIZE COMBINATIONS FOR SQUARE AND HEXAGONAL NUTS AND BOLT AND SCREW HEADS

| Nominal Head Dimensions and Size Combinations | | | | | | | | | | |
|---|---|---|---|---|---|---|---|---|---|---|
| | | ENGLISH in INCHES | | | | | | | | |
| | | | | British Standard | | | Nominal Size in MM | | | |
| METRIC in MM | | US Standard AF & SAE | | BA | W Whit-Worth | BS | US Standard AF & SAE | British BA | Standard W & BS | RATIO Maximum |
| 45 & | — | 1¾ | — | — | — | — | 44.4496 | — | — | 1.0124 |
| 46 & | — | 1 13/16 | — | — | — | — | 46.0371 | — | — | 1.0008 |
| 46 & | — | 1 13/16 & | — | — | 1⅛W & | 1¼BS | 46.0371 | — | 47.2436 | 1.0270 |
| 47 & | — | 1⅞ | — | — | — | — | 47.6246 | — | — | 1.0133 |
| 48 & | — | 1⅞ | — | — | — | — | 47.6246 | — | — | 1.0079 |
| 49 & | — | 1 15/16 | — | — | — | — | 49.2121 | — | — | 1.0043 |
| 50 & | — | 2 | — | — | — | — | 50.7996 | — | — | 1.0160 |
| 50 & | — | 1 15/16 | — | — | — | — | 49.2121 | — | — | 1.0160 |
| 55 & | — | 2 3/16 & | — | — | 1⅜W & | 1½BS | 55.5620 | — | 56.3875 | 1.0252 |
| 60 & | — | 2⅜ & | 2 7/16 | — | 1½W & | 1⅝BS | 60.3245 | — | 61.2135 | 1.0319 |
| | | | | | | | 61.9120 | | | |
| 65 & | — | 2 9/16 & | 2⅝ | — | 1⅝W & | 1¾BS | 65.0863 | — | 65.5314 | 1.0258 |
| | | | | | | | 66.6744 | | | |
| 70 & | — | 2¾ & | — | — | 1¾W & | 2BS | 69.8494 | — | 70.1034 | 1.0036 |
| 75 & | — | 3 | — | — | — | — | 76.1993 | — | — | 1.0160 |
| 75 & | — | 3 & | 2 15/16 | — | — | — | 76.1993 | — | — | 1.0213 |
| | | | | | | | 74.6119 | | | |
| 80 & | — | 3⅛ & | — | — | 2W & | 2¼BS | 79.3743 | — | 80.0093 | 1.0080 |
| 85 & | — | 3⅜ | — | — | — | — | 85.7243 | — | — | 1.0085 |
| 90 & | — | 3½ | — | — | 2¼W & | 2½BS | 88.8992 | — | 90.1692 | 1.0143 |
| 95 & | — | 3⅞ & | 3¾ & 3 13/16 | — | 2½W & | 2¾BS | 98.4241 | — | 98.8051 | 1.0360 |
| | | | | | | | 95.2492 | | | |
| | | | | | | | 96.8367 | | | |
| 100 & | — | 3⅞ & | — | — | 2½W & | 2¾BS | 98.4241 | — | 98.8051 | 1.0160 |
| 105 & | — | 4 3/16 & | 4⅛ & | — | 2¾W & | 3BS | 106.3616 | — | 106.1711 | 1.0152 |
| | | | | | | | 104.7741 | | | |
| 110 & | — | 4⅜ | — | — | — | — | 111.1240 | — | — | 1.0102 |
| 115 & | — | 4½ & | 4⅝ | — | 3W & | 3¼BS | 114.2990 | — | 115.0610 | 1.0278 |
| | | | | | | | 117.4740 | | | |
| 120 & | — | 4¾ & | 4⅞ | — | 3¼W & | 3½BS | 120.6489 | — | 123.1889 | 1.0319 |
| | | | | | | | 123.8239 | | | |
| 125 & | — | 4⅞ | — | — | 3¼W & | 3½BS | 123.8239 | — | 123.1889 | 1.0147 |
| 130 & | — | 5 & | 5⅛ & 5¼ | — | 3½W & | 3¾BS | 126.9989 | — | 131.5709 | 1.0500 |
| | | | | | | | 130.1739 | | | |
| | | | | | | | 133.3488 | | | |
| 135 & | — | 5⅜ & | 5¼ & | — | 3½W & | 3¾BS | 136.5238 | — | 131.5709 | 1.0376 |
| | | | | | | | 133.3488 | | | |
| 140 & | — | 5½ & | 5⅝ & | — | 3¾W & | 4BS | 139.6988 | — | 140.9688 | 1.0227 |
| | | | | | | | 142.8738 | | | |
| 145 & | — | 5⅝ & | 5¾ | — | — | — | 142.8738 | — | — | 1.0222 |
| | | | | | | | 146.0487 | | | |
| 150 & | — | 5⅞ | — | — | — | — | 149.2237 | — | — | 1.0052 |
| 155 & | — | 6⅛ | — | — | — | — | 155.5737 | — | — | 1.0037 |
| 160 & | — | 6¼ | — | — | — | — | 158.7486 | — | — | 1.0079 |
| 165 & | — | 6½ & | 6⅜ | — | — | — | 165.0986 | — | — | 1.0196 |
| | | | | | | | 161.9236 | | | |
| 170 & | — | 6⅝ & | 6¾ | — | — | — | 168.2735 | — | — | 1.0189 |
| | | | | | | | 171.4485 | | | |
| 175 & | — | 6⅞ | — | — | — | — | 174.6235 | — | — | 1.0022 |
| 180 & | — | 7 & | 7⅛ | — | — | — | 177.7985 | — | — | 1.0178 |
| | | | | | | | 180.9734 | | | |
| 185 & | — | 7¼ & | 7⅜ | — | — | — | 184.1484 | — | — | 1.0172 |
| | | | | | | | 187.3234 | | | |
| 190 & | — | 7½ & | 7⅝ | — | — | — | 190.4983 | — | — | 1.0169 |
| | | | | | | | 187.3234 | | | |

TABLE I-continued

WRENCH MARKINGS AND SIZE COMBINATIONS FOR SQUARE AND HEXAGONAL NUTS AND BOLT AND SCREW HEADS

| Nominal Head Dimensions and Size Combinations | | | | | | | | | | |
|---|---|---|---|---|---|---|---|---|---|---|
| | | ENGLISH in INCHES | | | | | | | | |
| | | | | British Standard | | | Nominal Size in MM | | | |
| METRIC in MM | | US Standard AF & SAE | | BA | W Whit-Worth | BS | US Standard AF & SAE | British BA | Standard W & BS | RATIO Maximum |
| 190 & | — | 7⅞ & | — | — | — | — | 193.6733 | — | — | 1.0193 |
| 195 & | — | 7¾ | — | — | — | — | 196.8483 | — | — | 1.0095 |
| 200 & | — | 7⅞ & | 8 | — | — | — | 200.0233 | — | — | 1.0160 |
| | | | | | | | 203.1983 | | | |
| 210 & | — | 8¼ & | 8¾ | — | — | — | 209.5482 | — | — | 1.0152 |
| | | | | | | | 212.7232 | | | |
| 220 & | — | 8⅝ & | 8¾ | — | — | — | 219.0731 | — | — | 1.0145 |
| | | | | | | | 222.2481 | | | |

The rotary wrenching tools of this embodiment of the invention will bear visually readable markings indicating the at least two and preferably three different head sizes for which they were designed. For example, the first wrench appearing in Table 1 may be marked "1.5 mm & 1/16 in. & 16 BA". The table has been computed using international (ISO) and many national standards and specifications from the United States (SAE, ANSI, MIL, ASTM), British (BS), German (DIN), France (FS), Yugoslavia (JUS), Japan (JS) and specifications from various manufacturers in the United States, England, France, Germany, Canada, Japan, Italy, Sweden, Spain, Czechoslovakia, Yugoslavia, Taiwan, China, Brazil, etc.

Figure 3:
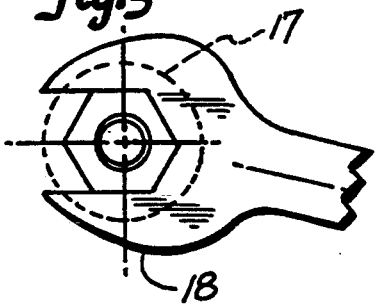
FIG. 3 is a broken-away plan view of a conventional four-contact point drive wrench similar to that of FIGS. 1 and 2.
Figure 4:
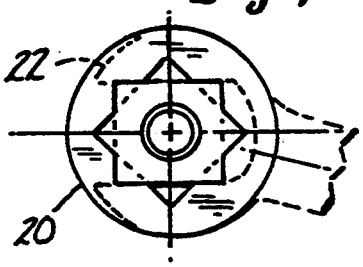
FIG. 4 is a broken-away plan view of a conventional wrench similar to that of FIG. 1 but having internal wrench flats designed for turning square bolt heads.

With reference to FIGS. 3–26, each figure shows positions of a bolt head within the gripping opening of a rotary wrenching tool, the bolt head positions shown in phantom lines referring to the smallest bolt head that can be hilly and adequately gripped by the tool. Certain of the Figures also show a wrenching tool in both a socket form (wherein a full circle in either solid or dotted lines appears about the bolt head) or in open-ended wrench form. In FIG. 3, for example, a socket is shown in dotted lines as (17), the open-ended wrenching tool version being shown in solid lines as (18). In FIGS. 4, 5, 7, 9–11, 13–19, 22 and 23, similarly, the socket embodiment is shown in solid lines as (20) and the open-ended embodiment is shown in phantom lines as (22). Further, alternate positions for the ends of the open-ended embodiments may be varied, and several Positions are shown, for example, in FIGS. 14, 24, 25 and 26.

The following non-limiting examples will serve to more clearly illustrate various further embodiments of the invention.

EXAMPLE I

Figure 16:
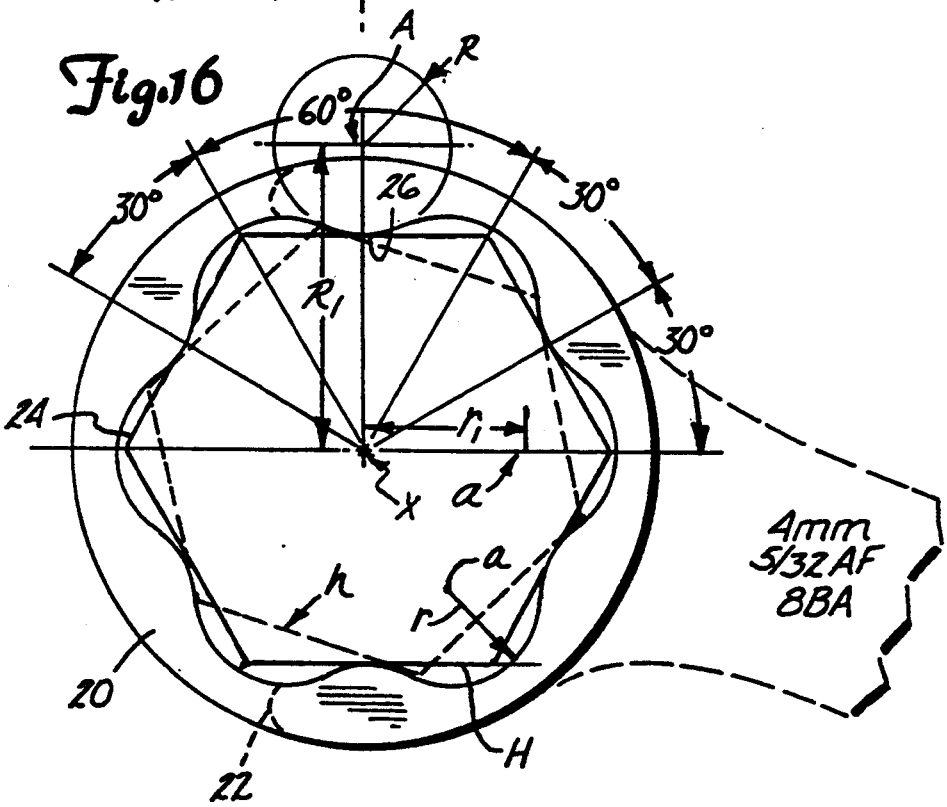
FIG. 16 is a broken-away plan view of a novel six-contact point wrenching system.

With reference to the embodiment shown in FIG. 16, socket and open-end rotary wrenching tools shown generally at (20) and (22) are sized so as to strongly and adequately grip the hexagonal heads of threaded fasteners sized 4 mm & 5/32" & 8 BA, giving a ratio of 1.0363. The wrench of FIG. 16, as shown frown the drawing, has an axis of rotation X that extends normal to the plane of the paper and has an opening for receiving the polygonal head of a threaded member, in this case, a hexagonal head shown as "H". The opening has an inner, head-confronting surface comprising a series of arcuate first surfaces (24) concave to the axis of the opening and spaced about the circumference of the opening. Each such first surface is defined generally as the locus of points falling a given radial distance r from a first axis "a" that is itself spaced a distance $r_1$ from, but parallel to, the axis X of the opening. Between the arcuate first surfaces (24) are positioned a series of arcuate second surfaces (26) which are convex to the axis of the opening and are spaced about its circumference, each such second arcuate surface being defined general as the locus of points falling a radial distance R from a second axis A which is itself spaced a distance $R_1$ from, but parallel to, the axis X of the opening. Each surface that forms the opening and that is contiguous to an arcuate surface tangentially merges into that arcuate surface. $R_1$ preferably is larger than $r_1$ , and the ratio $R_1/r_1$ desirably exceeds 1.5 and preferably exceeds 2.0. The arcuate second surfaces (26), it will be noted, form "lobes" having rounded surfaces for making contact with the flats of a hexagonal head of a threaded member. One such member, designated "h," is shown in operative contact with the lobes. Each second axis A is angularly spaced from at least one next adjacent second axis A by 60°.

With further reference to FIG. 16, rotary wrenching tools of this general configuration may be manufactured as socket, box-end, open-end, flare nut, nut driver and crowfoot wrenches, sized for receiving hexagonal fastener heads nominally sized as follows:

10 mm & ⅜" (AF) (ratio of 1.0499);

11 mm & 7/16" (AF) & 3/16 W (Whitworth) & ¼ BS (ratio of 1.0275);

19 mm & ¾" (AF) & ⅜ W & 7/16 BS (ratio of 1.0563).

Similarly, rotary wrenching tools configured as shown in FIG. 16 may be designed as socket, box-end and crowfoot wrenches, sized to accommodate hexagonal fastener heads nominally sized as 28 mm & 27 mm & 11/16" (AF) & 1⅛" (AF) & ⅝ W & 11/16 BS, the wrench having a ratio, as defined above, of 1.0588. Other wrenching tools configured as shown in FIG. 16 may be provided as socket and box-end tools sized to receive hexagonal fastener heads nominally sized as 32 mm & 33 mm & 15/16" (AF) & 1¼" (AF) & ¾ W & ⅞ BS, the wrench having a ratio of 1.0500. Yet another wrench configured as shown in FIG. 16 may be provided as a socket wrench sized to receive hexagonal fastener heads nominally sized as 220 mm & 8⅝" (AF) & 8¾" (AF), the ratio of which is 1.0145.

Figure 15:
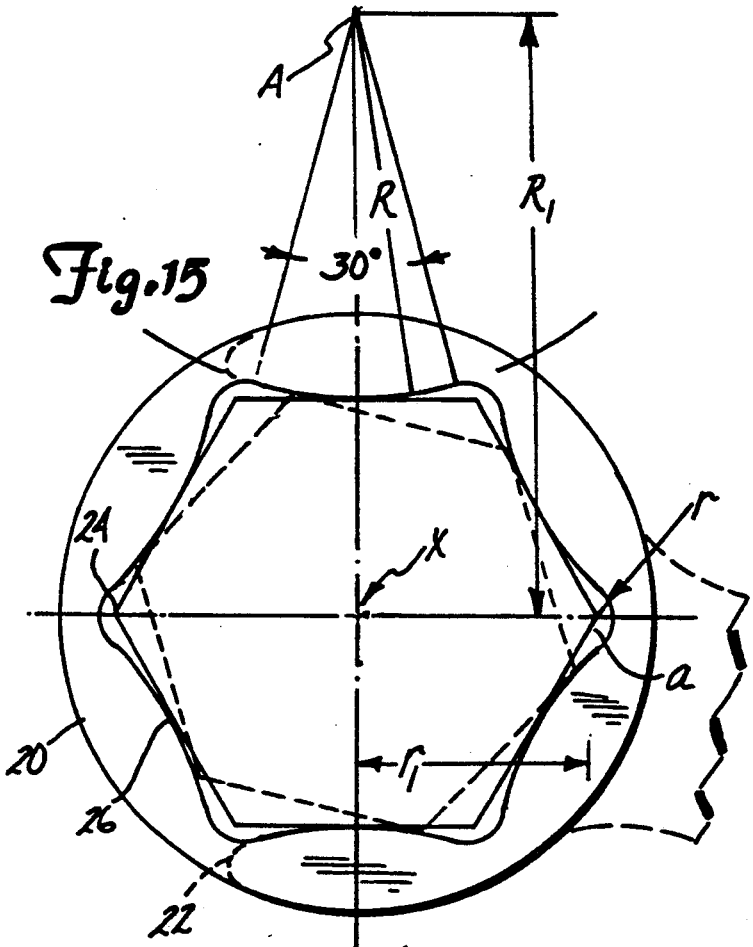
FIG. 15 is a broken-away plan view of a novel six-contact point wrenching system.

If the ratio R/r is substantially greater than 1.0, preferably exceeding about 5.0, and if $R_1$ is substantially larger than $r_1$, the particularly desirable configuration of the wrench shown in FIG. 15 is obtained. This embodiment makes use of large, gently rounded, inwardly projecting lobes (26) separated by rounded recessed arcuate portions (24), the latter providing room to accommodate comers of the head of a threaded member without coming into comer contact therewith. Again, each surface forming the opening that is contiguous to an arcuate surface tangentially merges into that surface.

EXAMPLE II

Socket and Box-End rotary wrenching tools configured as shown in FIG. 15 are sized to receive hexagonal heads of threaded members nominally sized 35 mm & 34 mm & 1⅜" (AF) & 1 5/16" (AF) & 13/16 W & 15/16 BS, the tool having a ratio, as defined above, of 1.0591. Similarly, socket wrenches may be designed in accordance with FIG. 15 and sized to receive hexagonal heads of threaded fasteners nominally sized as follows:

a) 105 mm & 4 3/16" (AF) & 4⅛" (AF) & 2¾ W & 3 BS, the ratio being 1.0152;
b) 140 mm & 5⅝" (AF) & 5½" (AF) & 3¾ W & 4 BS, the ratio of which wrench is 1.0227.
c) 200 mm & 7⅞" (AF) & 8" (AF), with a ratio of 1.0160.

Figure 18:
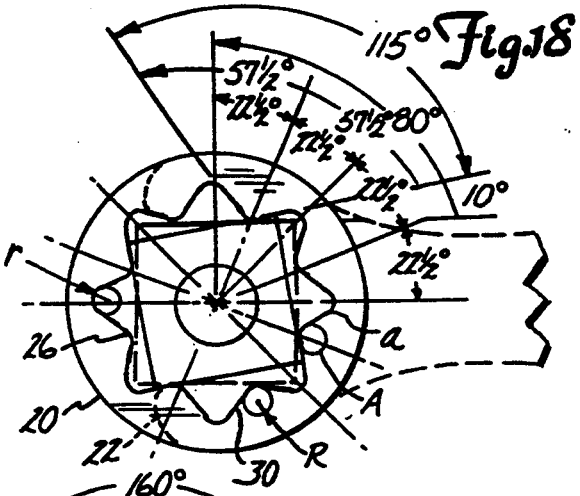
FIG. 18 is a broken-away plan view of a novel eight-contact point drive wrench for use with square bolt heads.

If the wrenching tool shown in FIG. 16 in which R is approximately equal to r is modified so that $R_1$ is approximately equal to $r_1$, then tools of the general type shown in FIGS. 18, 22 and 23 are obtained. Referring to FIG. 18, eight contact points or lobes (26) are provided. This wrenching tool is particularly adapted for receiving square heads of threaded fasteners. The inner surface of the tool includes portions designated (30) which are generally flat surfaces and that extend between the arcuate first and second surfaces. Such flat surfaces (30) may be oriented so as to come into generally surface-to-surface contact with the flats of a threaded member head, as shown in FIG. 18, the angular dimensions appearing in FIG. 18 being adapted to promote such surface-to-surface contact. FIG. 22 and 23 show tools somewhat similar to that shown in FIG. 18, except that the tool of FIG. 22 has its lobes angularly spaced 20° apart and the tool of FIG. 23 has its lobes spaced angularly 15° apart. Note is made that the spacing between adjacent second axes A of the embodiments of FIGS. 18, 22 and 23 are generally less than 3R in which R is as described above in connection with FIG. 16.

EXAMPLE III

Socket and box-end rotary wrenching tools may be designed and manufactured in the configuration shown in FIG. 18 and specifically sized in accordance with the invention to receive square heads of threaded fasteners nominally sized 13 mm & ½" (AF) & ¼ W & 5/16 BS, and having a ratio of 1.0500. Similarly, socket, box-end and open-end wrenching tools may be designed and manufactured in accordance with the configuration of FIG. 18 and sized for receiving square-headed fasteners nominally sized 16 mm & ⅝", and having a ratio of 1.0079. The same socket and box-end tools may be designed and manufactured in accordance with the configurations of FIGS. 22 and 23 and sized to receive hexagonal fastener heads nominally sized 16 mm & ⅝" (AF), the tools having a ratio of 1.0079.

Figure 19:
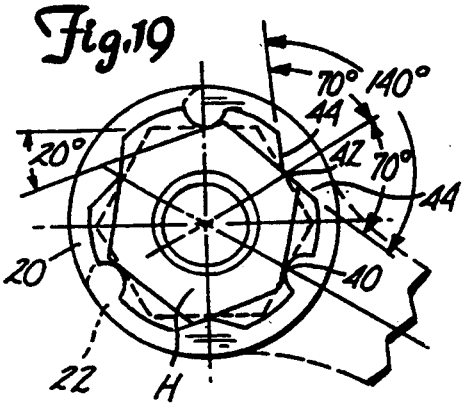
FIG. 19 is a broken-away plan view of a novel eight-contact point drive wrench utilizing a combination of wrenching elements.
Figure 20:
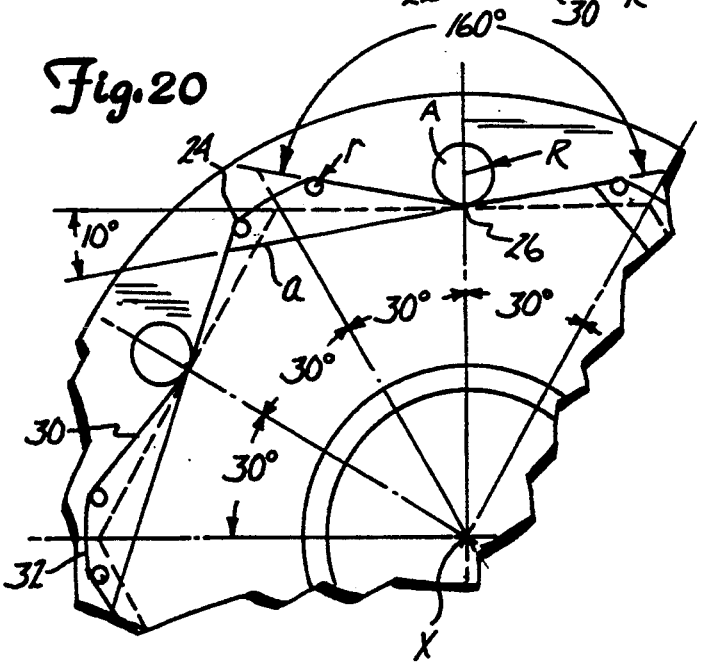
FIG. 20 is a broken-away plan view of a novel six-contact point drive wrenching system.

Using the nomenclature described above in connection with FIG. 16, the rotary wrenching tool of FIG. 20 is provided with inwardly convex lobes (26) foraged generally on radii R swung about axes A, the latter axes being angularly spaced about the axis of rotation X by 60°. Inwardly concave surfaces (24) are formed on radii r swung about axes a and positioned such that two spaced inwardly concave arcuate surfaces are positioned between each of the inwardly convex surfaces (26) forming lobes of the wrench. Generally flat surface portions (30) extend between adjacent inwardly concave and convex surfaces (24) and (26), the inwardly concave surfaces being joined by a surface (32) that is formed on a radius about the axis of rotation X. Again, each surface that forms the wrench opening and that is contiguous to an arcuate surface tangentially merges into that arcuate surface. The wrenching tools of FIGS. 19, 20 and 21 each have head-receiving openings configured to provide combinations of line, surface and flat-to-flat contact with differently sized fastener heads.

EXAMPLE IV

A socket wrenching tool designed and manufactured to have the configuration shown in FIG. 20 is specifically sized to receive hexagonal head fasteners nominally sized at 5 mm& 3/16" (AF) & 6 BA, the tool having a ratio of 1.0499. A similar tool is sized to receive hexagonal fastener nuts nominally sized 100 mm & 3⅞" (AF) & 2½ W & 2¾ BS, the tool having a ratio of 1.0160. Similarly, a wrenching tool fabricated in accordance with the configuration of FIG. 20 may be specifically sized to receive hexagonal head fasteners nominally sized at 14 mm & 9/16" (AF), the tool having a ratio of 1.0205. Socket and box-end wrenching tools configured as in FIG. 20 may be sized to specifically receive hexagonal fastener heads nominally sized 75 mm & 3" (AF) & 2 15/16" (AF), and having a ratio of 1.0213.

Figure 17:
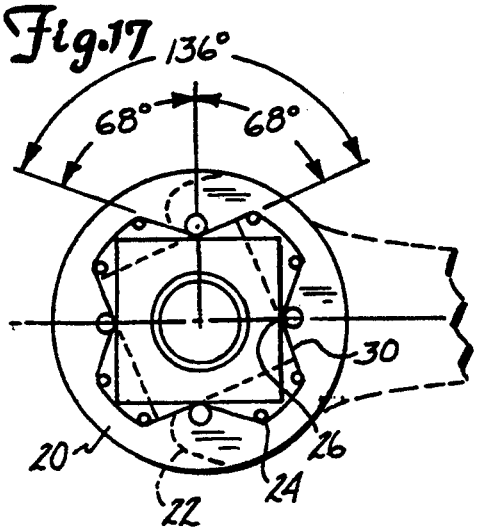
FIG. 17 is a broken-away plan view of a novel tour-contact point drive wrench for turning square bolt heads.
Figure 14:
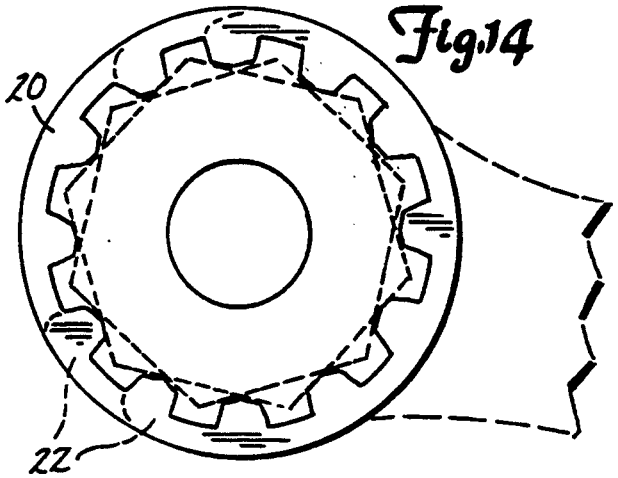
FIG. 14 is a broken-away plan view of a twelve-point "spline" drive wrench of the type shown in U.S. Pat. No. 3,675,516, used for turning splined members and also hexagonal bolt heads, which wrench can be sized in accordance with the present invention.

An embodiment similar to that described above in connection with FIG. 20 is shown in FIG. 17, this rotary tool having internally projecting lobes (26) spaced 90° from one another and having a pair of inwardly concave arcuate surfaces (24) formed between each pair of inwardly projecting lobes (26). Generally flat interior surfaces (30) extend between the arcuate surfaces and merge tangentially into such arcuate surfaces.

EXAMPLE V

Socket, box-end and open-end wrenching tools may be manufactured in accordance with the configuration shown in FIG. 17 and sized to receive square heads of threaded fasteners nominally sized as follows:

a) 11 mm & 7/16" (AF) & 0 BA (ratio of 1.0593)
b) 14 mm & 9/16" (AF) & 1/4 W & 5/16 BS (ratio of 1.0714)
c) 16 mm & 15 mm & 14 mm & 9/16" (AF) & ⅝" (AF) & 5/16 W & ⅜ BS (ratio of 1.1429).

FIG. 19 shows a wrenching tool having an opening adapted to receive hexagonal heads H of threaded members. The tool has an axis of rotation x, and the inner, head-confronting surface of the wrenching tool opening comprises three equiangularly spaced, inwardly convex arcuate first surfaces (40) and, forming a portion of the inner surface between said arcuate first surfaces inwardly convex arcuate second surfaces (42). The inner surface additionally includes at least one outwardly divergent pair of flat inner surface portions (44) that tangentially merge into each arcuate second surface (42). The head confronting inner surface of the tool additionally includes circumferential surface portions that extend between the flat inner surface portions and the arcuate first surfaces, the arcuate first surface portions (40) and second surface portions (42) being so arranged as to come into contact with the flats of a hexagonal head H. The first arcuate surfaces (40) are spaced angularly from one another by 120°, and the second arcuate surfaces are spaced from each other by 120° also, each first arcuate member being angularly spaced from an adjacent second arcuate member by 60°. Preferably, the pair of flats (44) diverge at an angle of 140° therebetween.

EXAMPLE VI

Socket and box-end wrenches are manufactured in accordance with the configuration of FIG. 19 and are specifically sized to receive hexagonal fastener heads nominally sized 8 mm & 5/16" (AF) & 2 BA, the wrench having a ratio of 1.0368. Socket, box-end, open-end, flare nut, nut driver and crowfoot wrenches may be manufactured in the configuration shown in FIG. 19 and specifically sized to receive hexagonal heads of fasteners having the following nominal sizes:

a) 11 mm & 7/16" (AF) & 0 BA (1.0593 ratio)

b) 16 mm & ⅝" (AF) & 5/16 W & ⅜ BS (1.0499 ratio)

Referring now to the rotary wrenching tool of FIG. 21, and utilizing the nomenclature referred to above in connection with FIG. 16, the tool includes an opening for receiving a hexagonal head of a threaded member and has an axis of rotation X. The tool includes an inner surface comprising a series of spaced, arcuate first surfaces (24) concave to the axis of rotation of the opening and angularly spaced from one another by an angle of 30°. A series of spaced, arcuate second surfaces (26) that are convex to the axis of rotation X of the opening are spaced about the opening between the first arcuate surfaces and are angularly spaced from one another by 30°. The inner surface of the opening includes flat surfaces (30) which extend between neighboring first and second arcuate surfaces. The flat surfaces (30) merge tangentially into the second arcuate surfaces (26), as shown, but intersect at approximately right angles the first arcuate surfaces. The first arcuate surfaces, as will now be understood, define recesses which serve to receive the comers of a hexagonal head H of a threaded member.

EXAMPLE VII

Socket, box-end, open-end, flare nut, nut driver and crowfoot wrenching tools may be manufactured in accordance with tile configuration of FIG. 21 and sized for receiving hexagonal fastener heads nominally sized 17 mm & 11/16" (AF) (1.0272 ratio), and also 21 mm & 13/16" (AF) & 7/16 W & ½ BS (1.0176 ratio).

Socket, box-end and nut driver wrenching tools may be manufactured in accordance with tile configuration of FIG. 21 and sized to receive hexagonal fastener heads nominally sized as 24 mm & 15/16" (AF) & ½ W & 9/16 BS (1.0271 ratio). Socket, box-end and crowfoot wrenching tools may be manufactured in accordance with the configuration of FIG. 21 and sized to receive hexagonal fastener heads nominally sized as 32 mm & 1¼" (AF) & ¾ W & ⅞ BS (1.0400 ratio). A socket wrench may be manufactured in accordance with the configuration of FIG. 21 and sized to receive hexagonal fastener heads nominally sized as 95 mm & 3⅞" (AF) & 3¾ (AF) & 3 13/16" (AF) & 2½ W & 2¾ BS (1.0360 ratio).

Referring to FIG. 24, a wrenching tool for receiving a polygonal head is shown with its inner surface comprising a series of arcuate first surfaces (46) that are convex to the axis of rotation of the head-receiving opening and are spaced equiangularly about the opening, each arcuate surface being defined generally as the locus of points falling a given radial distance R from an axis A parallel to but spaced from the axis of rotation X of the tool and each such axis A being angularly spaced frown the next adjacent axis by an angle of 20° (FIG. 26) or 30° (FIGS. 24 and 25). The inner surface of the wrench opening includes circumferential surface portions (48) which intersect the arcuate surfaces at approximately right angles. In FIGS. 24 and 26, the circumferential surface sections (48) are equally spaced from the axis of rotation H, whereas in FIG. 25, each second circumferential surface section (48) spaced from the axis of rotation of the wrench opening by a given distance $S_1$ and each circumferential section therebetween is spaced from the axis of rotation of the wrench by a distance $S_2$, $S_1$ being greater than $S_2$. In FIG. 26, at Section "A", it can be seen that the circumferential surface portions can be replaced by inwardly concave arcuate portions which merge tangentially into the inwardly convex portions (46).

EXAMPLE VIII

Socket, box-end and open end wrenches may be manufactured in accordance with the configurations of FIGS. 24 and 25, and sized for receiving hexagonal fastener heads nominally sized at 70 mm & 2¾" (AF) & 1¾ W & 2 BS (1.0036 ratio). Further, socket, box-end and open-end wrenches may be manufactured in accordance with the configuration of FIG. 25 and sized to specifically receive hexagonal fastener heads nominally sized at 75 mm & 3" (1.0160 ratio).

Preferably, the wrenching tools exemplified in FIGS. 15–26 likewise carry markings adjacent each tool opening identifying at least two and preferably three or more different fastener head sizes that the opening will strongly and adequately engage. Exemplary markings are shown in FIG. 16, the markings (4 mm & 5/32 AF & 8 BA) being stamped, in this example, onto or into tile handle of tile tool. Rotary wrenching tools in the form of sockets would normally have markings on the outer socket surfaces.

While a preferred embodiment of the present invention has been described, it should be understood that various changes, adaptations and modifications may be made therein without departing from tile spirit of tile invention and the scope of tile appended claims.

What is claimed is:

1. A rotary wrenching tool having an opening for receiving a polygonal head of a threaded member, the opening having an axis of rotation and having an inner surface comprising a series of spaced, arcuate first surfaces concave to the axis of rotation of the opening, each such first surface being defined generally as the locus of points falling a given radial distance "r" from a first axis itself spaced a distance $r_1$ from, but parallel to, the axis of rotation of the opening, and a series of spaced arcuate second surfaces convex to the axis of rotation of tile opening, each such second surface being defined generally as the locus of paints falling a given radial distance R from a second axis itself spaced a distance $R_1$ from the axis of rotation, and each of said first surfaces tangentially merging into a second surface, wherein the ratio $R_1/r_1$ exceeds 1.5.

2. The tool of claim 1 wherein the ratio R/r exceeds 5.0.

3. The tool of claim 1 wherein each second axis is angularly spaced from at least one adjacent second axis by 45°.

4. The tool of claim 1 wherein each second axis is angularly spaced from at least another second axis by 90°, the inner surface of the opening including, between two next adjacent arcuate second surfaces, two arcuate first surfaces.

5. The tool of claim 1 wherein each second axis is angularly spaced from another second axis by 60° to configure said opening to receive hexagonal heads, the inner surface of the opening having two arcuate first surfaces disposed between two next adjacent arcuate second surfaces.

6. The tool of claim 1 further comprising flat surfaces disposed between and tangentially merging with the first and second surfaces.

7. The tool of claim 1 wherein r, $r_1$, R, and $R_1$ are selected to yield a tool opening sized to receive strongly and adequately heads of threaded members sized in at least two different nominal sizes, further comprising visible indicia identifying the at least two different nominal sizes.

8. The tool of claim 7 wherein the maximum ratio of the nominal distances across opposing flats of said threaded members ranges from about 1.0053 to about 1.1430 for square heads.

9. The tool of claim 7 wherein the maximum ratio of the nominal distances across opposing flats of said threaded members ranges from about 1.0053 to about 1.0600 for hexagonal heads.

10. The tool of claim 1 wherein each second axis is angularly spaced from another second axis by 30°.

11. The tool of claim 1 wherein each second axis is angularly spaced from another second axis by 20°.

12. The tool of claim 1 wherein each second axis is angularly spaced from another second axis by 15°.

13. The tool of claim 1 wherein R is substantially equal to r.

14. The tool of claim 13 further comprising flat surfaces disposed between and tangentially merging with the first and second surfaces.

15. The tool of claim 1 wherein the ratio of $R_1/r_1$ exceeds 2.0.

16. The tool of claim 1 further comprising a threaded member received within the opening, the threaded member having comers and flats, each of the flats of the threaded member being in contact with one of said second surfaces.

17. The tool of claim 16 wherein each of the corners of the threaded member is disposed between two next adjacent second surfaces and being spaced from a first surface disposed between the two next adjacent second surfaces.

18. The tool of claim 1 wherein the tool is a socket wrench.

19. The tool of claim 1 wherein the tool is a box-end wrench.

20. A rotary wrenching tool having an opening for receiving a polygonal head of a threaded member, the opening having an axis of rotation and having an inner surface comprising a series of spaced, arcuate first surfaces concave to the axis of rotation of the opening, each such first surface being defined generally as the locus of points falling a given radial distance "r" from a first axis itself spaced a distance $r_1$ from, but parallel to, the axis of rotation of the opening, and a series of spaced arcuate second surfaces convex to the axis of rotation of the opening, each such second surface being defined generally as the locus of paints falling a given radial distance R from a second axis itself spaced a distance $R_1$ from the axis of rotation, and each of said first surfaces tangentially merging into a second surface, wherein the ratio $R_1/r_1$ is at least about 2.0.

21. The tool of claim 20 further comprising a threaded member received within the opening, the threaded member having comers and flats, each of the flats of the threaded member being in contact with one of said second surfaces.

22. The tool of claim 20 wherein each of the comers of the threaded member is disposed between two next adjacent second surfaces and being spaced from a first surface disposed between the two next adjacent second surfaces.

23. The tool of claim 20 wherein the tool is a socket wrench.

24. The tool of claim 20 wherein the tool is a box-end wrench.

25. The tool of claim 20 further comprising visible indicia identifying at least two different nominal sizes of threaded members sized to be received within the opening for rotation by the tool.

* * * * *